US009714489B2

(12) United States Patent
Stubler et al.

(10) Patent No.: US 9,714,489 B2
(45) Date of Patent: Jul. 25, 2017

(54) METHOD OF DAMPING THE VIBRATIONS OF STAY CABLES AND ASSOCIATED SYSTEM

(75) Inventors: Jérôme Stubler, Paris (FR); Erik Mellier, Versailles (FR)

(73) Assignee: SOLETANCHE FREYSSINET, Rueil Malmaison (FR)

( * ) Notice: Subject to any disclaimer, the term of this patent is extended or adjusted under 35 U.S.C. 154(b) by 609 days.

(21) Appl. No.: 13/026,152

(22) Filed: Feb. 11, 2011

(65) Prior Publication Data

US 2011/0277252 A1 Nov. 17, 2011

(30) Foreign Application Priority Data

May 12, 2010 (RU) ..... 2010119171

(51) Int. Cl.
*E01D 11/00* (2006.01)
*E01D 11/04* (2006.01)
*E01D 19/16* (2006.01)

(52) U.S. Cl.
CPC ..... *E01D 11/04* (2013.01); *E01D 19/16* (2013.01)

(58) Field of Classification Search
CPC ..... E01D 11/04; E01D 19/16
USPC ..... 14/11, 18–30; 188/281–284
See application file for complete search history.

(56) References Cited

U.S. PATENT DOCUMENTS

| | | | | |
|---|---|---|---|---|
| 2,358,672 | A * | 9/1944 | Vartia | 14/18 |
| 3,049,194 | A * | 8/1962 | Brendel | 52/1 |
| 3,128,858 | A * | 4/1964 | Kumezawa | 191/41 |
| 4,231,112 | A * | 10/1980 | Massa | 367/158 |
| 4,346,255 | A * | 8/1982 | Nigol | 174/42 |
| 6,439,552 | B1 * | 8/2002 | Ageishi et al. | 267/122 |
| 2007/0061982 | A1 | 3/2007 | Lecinq et al. | 14/22 |

FOREIGN PATENT DOCUMENTS

| | | |
|---|---|---|
| DE | 101 61 972 | 6/2003 |
| SU | 1182102 | 4/1983 |

OTHER PUBLICATIONS

Dipl.-Ing. Mark Bresler (Mauer Söhne), 2008, pp. 1-11, URL=http://www.maurer-soehne.ru/files/bauwerkschutzsysteme/pdf/en/brochure/RU_new_technical_developments.pdf, accessed on May 16, 2011.

* cited by examiner

*Primary Examiner* — Raymond W Addie
(74) *Attorney, Agent, or Firm* — Seed IP Law Group LLP

(57) ABSTRACT

A method of damping the vibrations of at least one pair of stay cables of a civil engineering structure, in which the stay cables of said pair are linked by a damper having a first stiffness in response to tensile stress and a second stiffness in response to compressive stress, the first stiffness being greater than the second stiffness.

31 Claims, 12 Drawing Sheets

METHOD OF DAMPING THE VIBRATIONS OF STAY CABLES AND ASSOCIATED SYSTEM

CROSS-REFERENCE TO RELATED APPLICATION

This application claims the benefit under 35 U.S.C. §119 (e) of Russian Patent Application No. 2010119171 filed May 12, 2010, which application is incorporated herein by reference in its entirety.

BACKGROUND OF THE INVENTION

The present invention relates to damping the vibrations of at least two stay cables of a civil engineering structure.

By way of non-limitative example, the damping proposed by the invention can in particular serve to damp the vibrations of a stay cable array of a cable-stayed bridge. In cable-stayed bridges, the stay cables forming the stay cable array are generally anchored at their upper end on a pylon and at their lower end on the bridge deck. The stay cable array thus ensures the support and stability of the structure.

However, under certain conditions, in particular when the bridge deck undergoes periodic excitations, the stay cables can build up energy and vibrate significantly. The two main causes of these vibrations are the movement of the stay cable anchors with respect to the deck under the effect of traffic loads, and the effect of the wind acting directly on the stay cables. When uncontrolled, such vibrations are capable of directly damaging the stay cables, while being a source of anxiety to users present on the bridge deck.

In order to avoid or limit the vibrations of the stay cables of a civil engineering structure, it is known to use interconnecting cables that allow for a plurality of stay cables of a single stay cable array to be linked together, the interconnecting cables being moreover directly anchored on the bridge deck. The interconnecting cables allow for the whole stay cable array to be stiffened while allowing for certain, mainly in-plane, vibration modes of said stay cables to be prevented.

However, when interconnecting cables are used for linking together a plurality of stay cables, the following parameters must be taken into account:

- the cross-section, rigidity and tension of the interconnecting cables must be determined by an overall calculation of the array of interconnected stay cables;
- the strength of the interconnecting cables and of their anchors must be appropriate in extreme load scenarios such as road traffic on the bridge deck or a turbulent wind on the construction or the stay cables;
- the pre-tensioning of the interconnecting cables must make it possible to avoid any de-tensioning under extreme load; a de-tensioned interconnecting cable no longer serves its purpose and can undergo shocks that are harmful to the durability of the anchors, which is also likely to lead to a breakage of said interconnecting cable and therefore its replacement by another interconnecting cable having a greater cross-section and rigidity while being tensioned to a higher tension value;
- angular fractures of the ends of the stay cables at the level of the anchors must also be assessed, and corrected if necessary.

Taking into account these different parameters thus complicates to a relatively significant extent the installation of the interconnecting cables in order to stiffen the stay cable array of a civil engineering structure.

Moreover, when such interconnecting cables must be installed after the commissioning of the civil engineering structure, in order for example to correct stability problems, it is essential as described above to pre-tension the set of interconnecting cables, which therefore alters the geometry of the different stay cables of the stay cable array, with consequences for the structure of the construction and in particular the appearance of angular fractures at the level of the ends of the stay cables directly anchored on the pylon and on the bridge deck in the case of cable-stayed bridges.

Another solution consists of using dampers arranged between the stay cables and the structure of the construction or even directly interposed between the stay cables, so as to dissipate a portion of the vibratory energy of the stay cables.

In the interests of efficiency in particular, these dampers are traditionally symmetrical dampers, i.e. they function substantially in the same manner when they are subjected to tensile stress or compressive stress. Typically these are piston dampers having a rectilinear stroke which satisfy a symmetrical and increasing relationship between the force developed and the displacement speed of the piston when they are working under tension (lengthening) or compression (shortening). The symmetry of the relationship is understood from the identical or near-identical behaviour of these dampers under tension and under compression.

However, when operating under compression, the reaction force of the piston can be a source of instability.

By way of example, a stay cable array of a cable-stayed bridge can be considered, in which a respective damper links each pair of adjacent stay cables of the array, the dampers running on from each other. When two dampers on either side of a stay cable are compressed, the stay cable held between these two elements risks being pushed outside the plane of the array.

This instability means that the dampers no longer work.

The present invention makes it possible to limit at least some of the above-mentioned drawbacks.

SUMMARY OF THE INVENTION

To this end, the invention thus proposes a method of damping the vibrations of at least one pair of stay cables of a civil engineering structure, in which the stay cables of said pair are linked by a damper having a first stiffness in response to tensile stress and a second stiffness in response to compressive stress, the first stiffness being greater than the second stiffness.

In the context of the present invention, by the "stiffness" of a damper is meant the relationship between the force developed by the damper and the (relative) speed of displacement of an active element of the damper. The stiffness of the damper can for example be considered as a coefficient of proportionality between these two notions of force and speed. If the damper in question uses a viscous element such as a fluid for example, the stiffness of the damper is thus comparable to a viscosity coefficient. Such stiffness should not be confused with the known concept of proportionality between force and displacement (rather than speed), as in the case of a spring for example.

The use of a damper makes it possible to limit at least some of the drawbacks of the above-mentioned interconnecting cables. Moreover the difference in stiffness under tension and compression of the damper makes it possible to limit at least some of the drawbacks of the above-mentioned symmetrical dampers.

According to advantageous embodiments that can be combined in all conceivable ways:

the damper is placed so that an operating axis of said damper is substantially perpendicular to the stay cables of said pair;

the damper is a damper having a substantially rectilinear stroke; this damper can use a piston or not;

the damper operates by a viscous fluid flowing between two chambers separated by a piston, the viscous fluid flow taking place through at least one passage that creates a pressure difference when the viscous fluid passes between the two chambers;

the pressure difference created by the passage of the fluid is less when the damper is working under compression in comparison with its working under tension;

the damper operates by a viscous fluid flowing between two chambers separated by a piston, the viscous fluid flow taking place, in response to tensile stress on the damper, through at least one first passage arranged in the piston and covered at the exit by at least one first valve, and, in response to compressive stress on the damper, through at least one second passage arranged in the piston and covered at the exit by at least one second valve;

the damper has at least one of the following two characteristics: said first valve has less flexibility than said second valve, and said first passage has a smaller transverse cross-section than said second passage;

the first stiffness is greater than the second stiffness by a ratio of at least 1 to 1.2;

the second stiffness is almost zero;

one of the stay cables of said pair of stay cables is moreover connected to a fixed element of the civil engineering structure by means of a damper having a first stiffness in response to tensile stress and a second stiffness in response to compressive stress, the first stiffness being greater than the second stiffness;

the connection between the damper and at least one of the stay cables of said pair allows said stay to rotate about the axis;

the civil engineering structure comprises at least one array of stay cables situated substantially in the same plane and including said pair of stay cables;

the damper is placed so that an operating axis of said damper is substantially in said plane of the stay cable array;

the stay cable array is constituted of at least three stay cables, and dampers link at least certain pairs s of adjacent stay cables of the stay cable array, at least one of said dampers having a first stiffness in response to tensile stress and a second stiffness in response to compressive stress, the first stiffness being greater than the second stiffness;

the dampers connecting the successive pairs of adjacent stay cables do not run on from each other; and/or the civil engineering structure comprises a cable-stayed bridge.

The invention also proposes a system comprising a civil engineering structure and a damper arranged in order to damp the vibrations of at least one pair of stay cables of the civil engineering structure according to the above-mentioned method, said damper being connected to the stay cables of said pair and having a first stiffness in response to tensile stress and a second stiffness in response to compressive stress, the first stiffness being greater than the second stiffness.

Other characteristics and advantages of the present invention will become apparent from the following description of non-limitative embodiments, with reference to the attached drawings.

DESCRIPTION OF PREFERRED EMBODIMENTS

The invention relates to damping the vibrations of at least one pair of stay cables of a civil engineering structure. The case will be considered below in which the vibrations of at least two stay cables of a cable-stayed bridge are damped. This example is however given by way of illustration only and in no way limits the general scope of the invention. By way of an alternative example of a civil engineering structure including at least two stay cables, to which the present invention can be applied, a building, a column capital, or other can be mentioned.

Figures 1, 2:
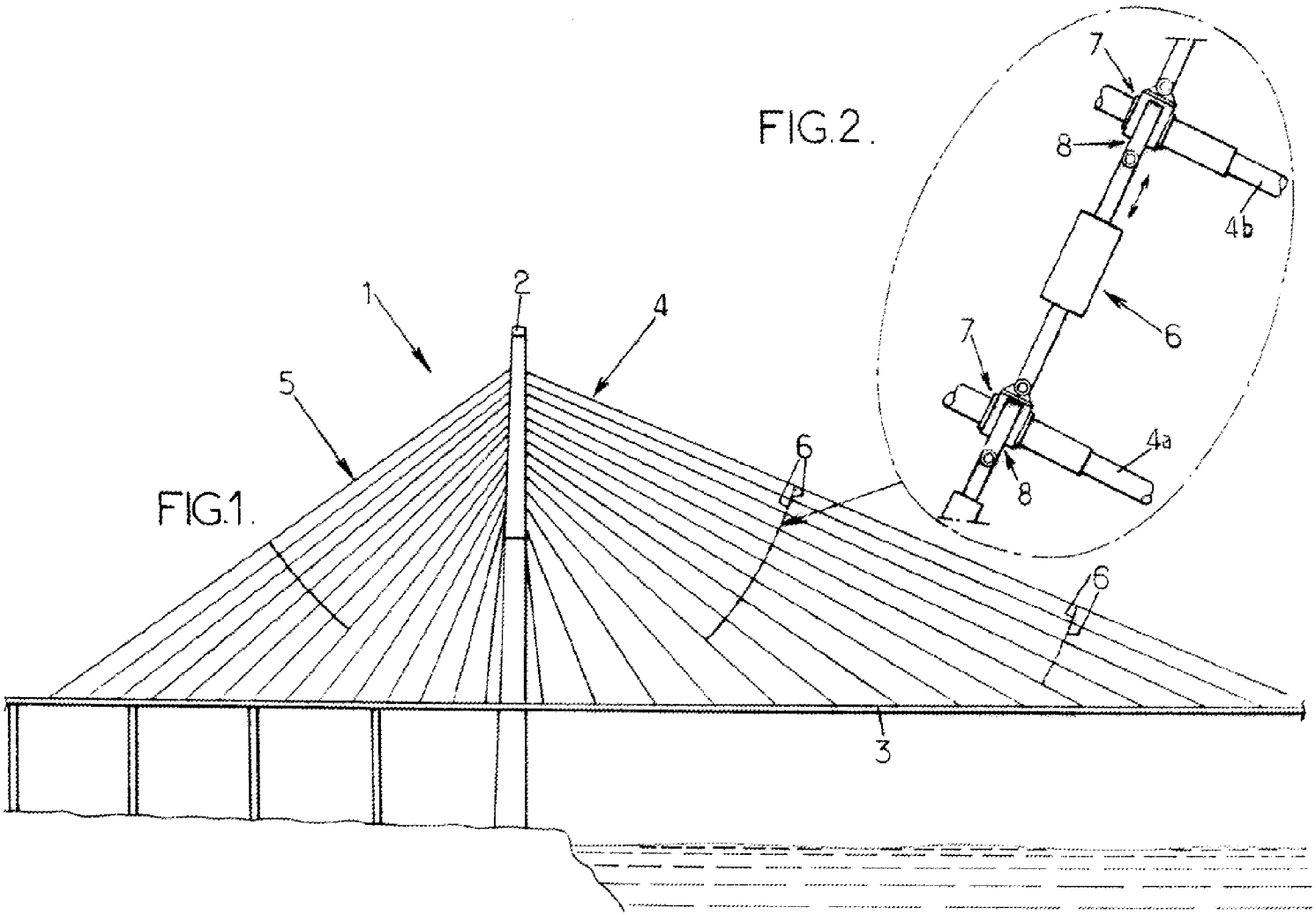
FIG. 1 is a diagram showing an example of a civil engineering structure comprising stay cables the vibrations of which are damped according to an embodiment of the invention.
FIG. 2 is a diagram showing a detail of the damping for a sub-portion of the civil engineering structure in FIG. 1.

FIG. 1 shows a cable-stayed bridge 1 that comprises at least one pylon 2, a deck 3 and, in the example considered here, two stay cable arrays 4 and 5 that connect the deck 3 to the pylon 2.

The stay cable arrays 4 and 5 are used to support the portion of the deck 3 that does not rest on supporting pylons (portion of the deck located to the right of the pylon 2 in the example considered here).

The stay cable array 4 is formed by a set of stay cables, situated substantially in the same plane, which are inclined downwards and towards the right, each stay having an upper end anchored in a respective anchor zone arranged on the pylon 2 and a lower end anchored on the deck 3. Similarly the stay cable array 5 comprises, substantially in the same plane, a set of stay cables inclined downwards and towards the left, each stay cable of this stay cable array 5 having an upper end directly anchored in a respective anchor zone arranged on the pylon 2, and a lower end anchored on the deck 3.

In a manner known per se, each stay cable can be formed from a bundle of metal strands that are anchored at both ends, and a plastic sheath that surrounds and protects the bundle of metal strands on the outside, in particular from corrosion. This sheath 42 can for example be produced from high-density polyethylene (HDPE).

FIG. 2 shows a detailed view of a portion of the stay cable array 4, and more particularly of a first stay cable 4*a* and of a second stay cable 4*b* that are linked together by a damper 6.

According to the present invention, the damper 6 is such that it has a first stiffness in response to tensile stress and a second stiffness in response to compressive stress, the first stiffness being greater than the second stiffness.

In other words, unlike the dampers usually used in cable-stayed civil engineering structures, the damper 6 operates differently depending on whether it is operating under tension or under compression. At first sight, such an asymmetrical damper appears less efficient than a symmetrical damper. If the stiffness under compression is zero, the efficiency is approximately divided by two, since only one half of the oscillation cycle is used to dissipate the vibration energy. This loss of efficiency dissuades a person skilled in the art from using an asymmetrical damper in order to damp the vibrations of at least one stay cable of a civil engineering structure. But there are advantages resulting from such a use, as will be disclosed below.

Moreover, it can be observed that with a carefully calculated ad hoc adjustment, it is possible to exceed the threshold of half of the average damping with a slightly "stiffer" adjustment of the force/speed ratio than that of the optimum linear calculation. As a result, the loss of efficiency resulting from the use of an asymmetrical damper can be reduced.

An asymmetrical damper is such that the ratio between the force developed on the latter and the speed of displacement of one of its mobile elements is not identical depending on whether it is operating under tension or under compression.

Figure 3:
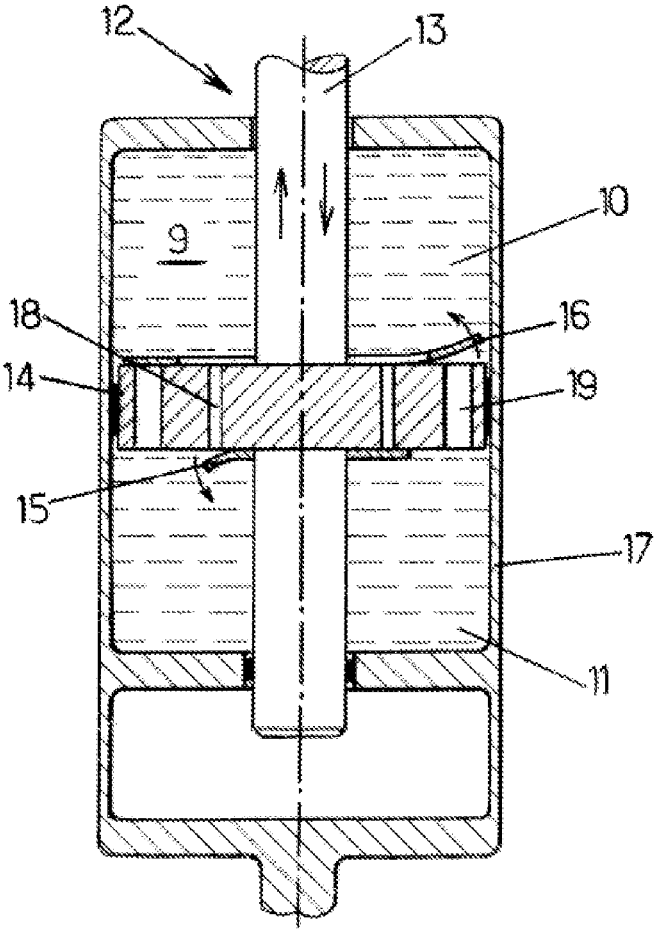
FIG. 3 is a diagram showing a non-limitative example of an asymmetrical damper capable of being used within the framework of the invention.

A non-limitative example of such an asymmetrical damper is shown in FIG. 3. This is a piston damper having a substantially rectilinear stroke.

The piston 12 comprises a rod 13 and a transverse part 14. It moves along the axis of the rod 13, within a piston body 17. Its transverse part 14 delimits two piston chambers 10 and 11, filled with a viscous fluid, such as oil for example.

The behaviour of the damper under tension (i.e. when the rod 13 leaves the body 17) is shown diagrammatically on the left part of FIG. 3, while its behaviour under compression (i.e. when the rod 13 returns into the body 17) is shown diagrammatically on the right part of FIG. 3.

As regards the behaviour of the damper under tension, at least one passage 18 (two passages in FIG. 3) is arranged in the transverse part 14 of the piston 12. A corresponding valve (or "strip") 15 covers the exit of the passage 18, situated below the transverse part 14 of the piston 12 in the example in FIG. 3. The valve 15 deforms during the withdrawal of the rod 13 from the body 17, so as to allow a certain quantity of fluid 9 to pass from the chamber 10 into the chamber 11.

A similar behaviour exists under compression of the damper. At least one passage 19 (two passages in FIG. 3) is arranged in the transverse part 14 of the piston 12. A corresponding valve (or "strip") 16 covers the exit of the passage 19, situated on the transverse part 14 of the piston 12 in the example in FIG. 3. This valve 16 deforms during the return of the rod 13 into the body 17, so as to allow a certain quantity of fluid 9 to pass from the chamber 11 into the chamber 10.

In order to provide a greater stiffness of the damper under tension than under compression, several possibilities can be envisaged.

It is possible for example to use a valve 15 having less flexibility than the valve 16. This difference in flexibility can be obtained by providing a thickness for the valve 15 that is greater than that of the valve 16. As a variant or in addition, a more rigid material can be used for the valve 15 than for the valve 16. The purpose of these different possibilities is to provide resistance to the passage of the fluid 9 from one chamber to the other that is greater for the valve 15 than for the valve 16.

As a variant or in addition, the passage 18 used under tension has a smaller transverse cross-section than the passage 19 used under compression. In this way, it is harder for the fluid 9 to pass from the chamber 10 to the chamber 11 (i.e. there is greater resistance force) under tension than for the fluid 9 to pass from the chamber 11 to the chamber 10 under compression, for an equivalent displacement of the piston 12 with respect to the body 17.

Other measures can also be envisaged in order to provide the difference in stiffness of the damper under tension and under compression, instead of or in addition to those just described, as a person skilled in the art may see fit.

Figure 4:
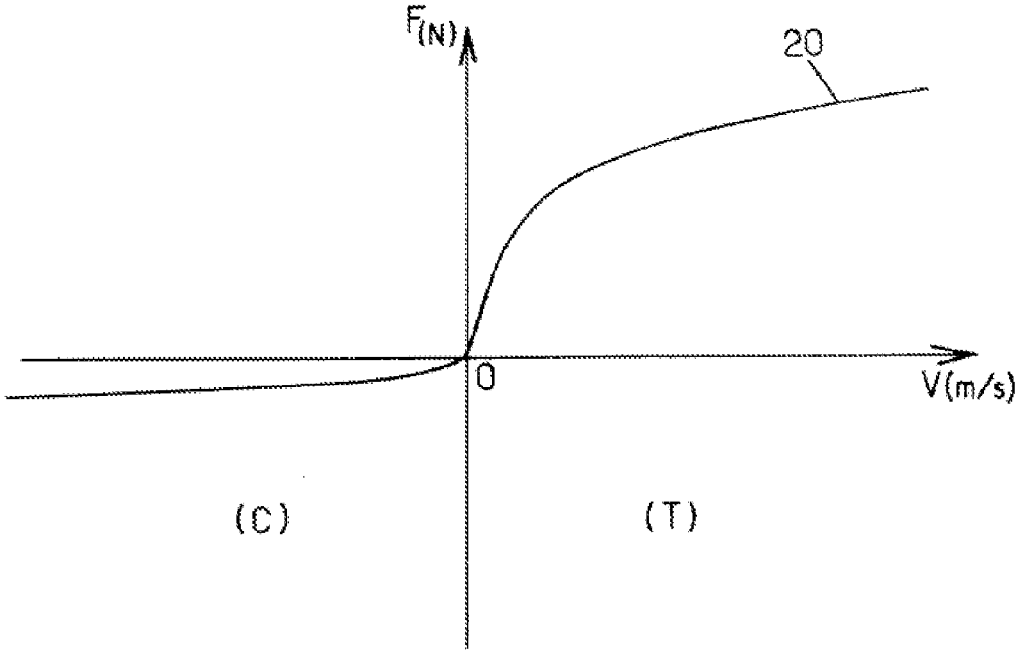
FIG. 4 is a graph showing a non-limitative example of force/speed behaviour law of an asymmetrical damper capable of being used within the framework of the invention.
Figure 5:
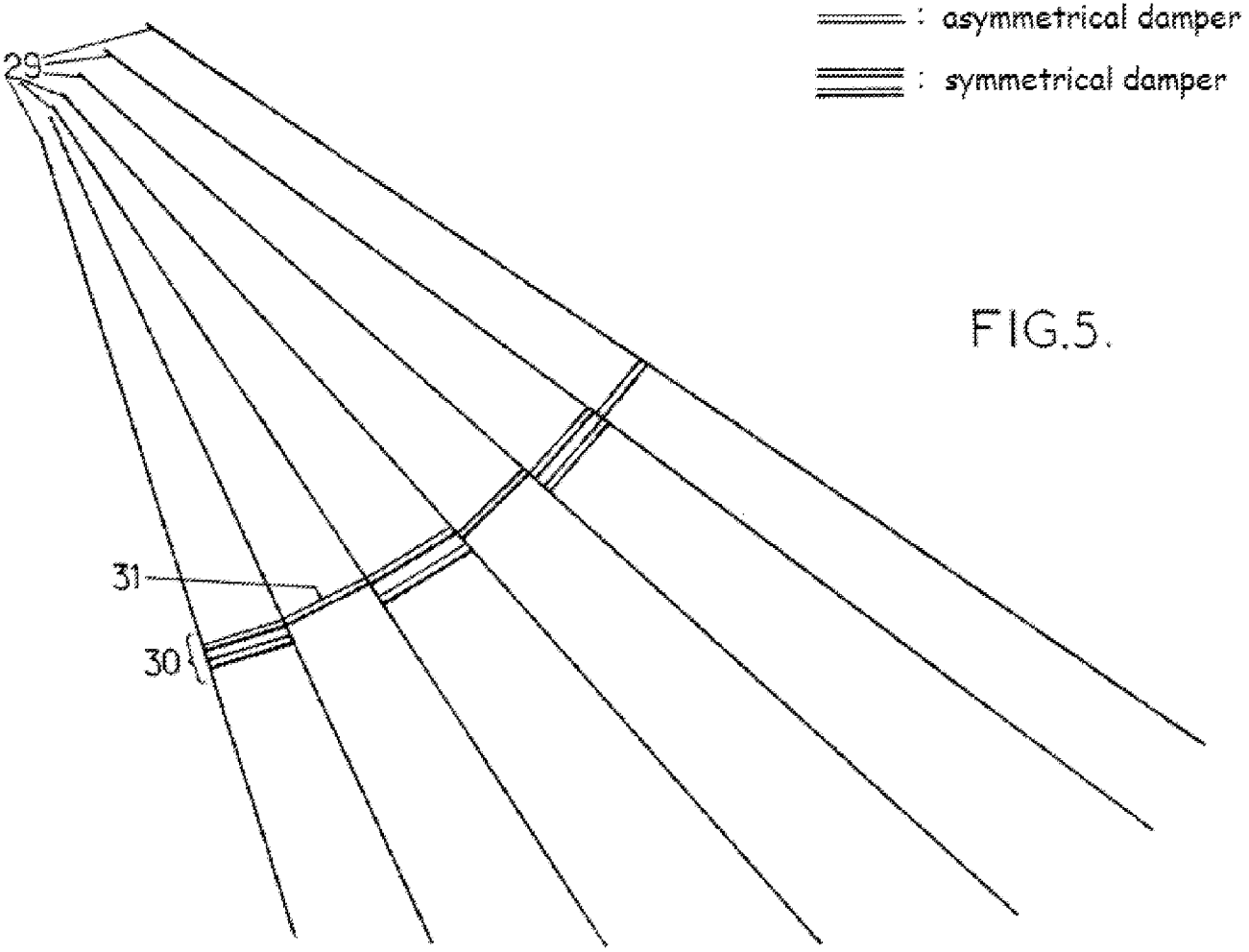
FIGS. 5 to 13 provide non-limitative examples of damping of a stay cable array using a plurality of asymmetrical dampers and optionally symmetrical dampers.
Figure 6:
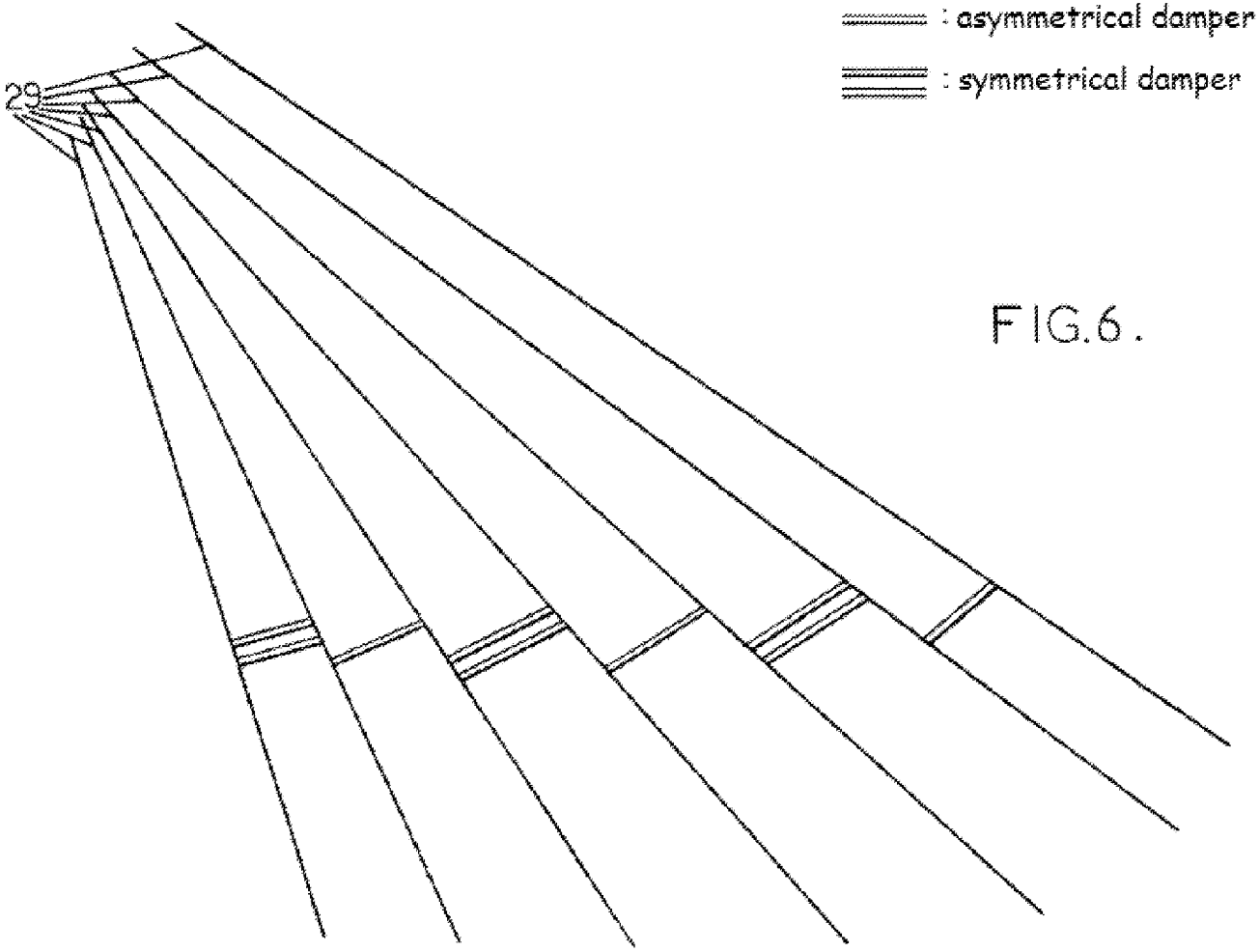
Figure 7:
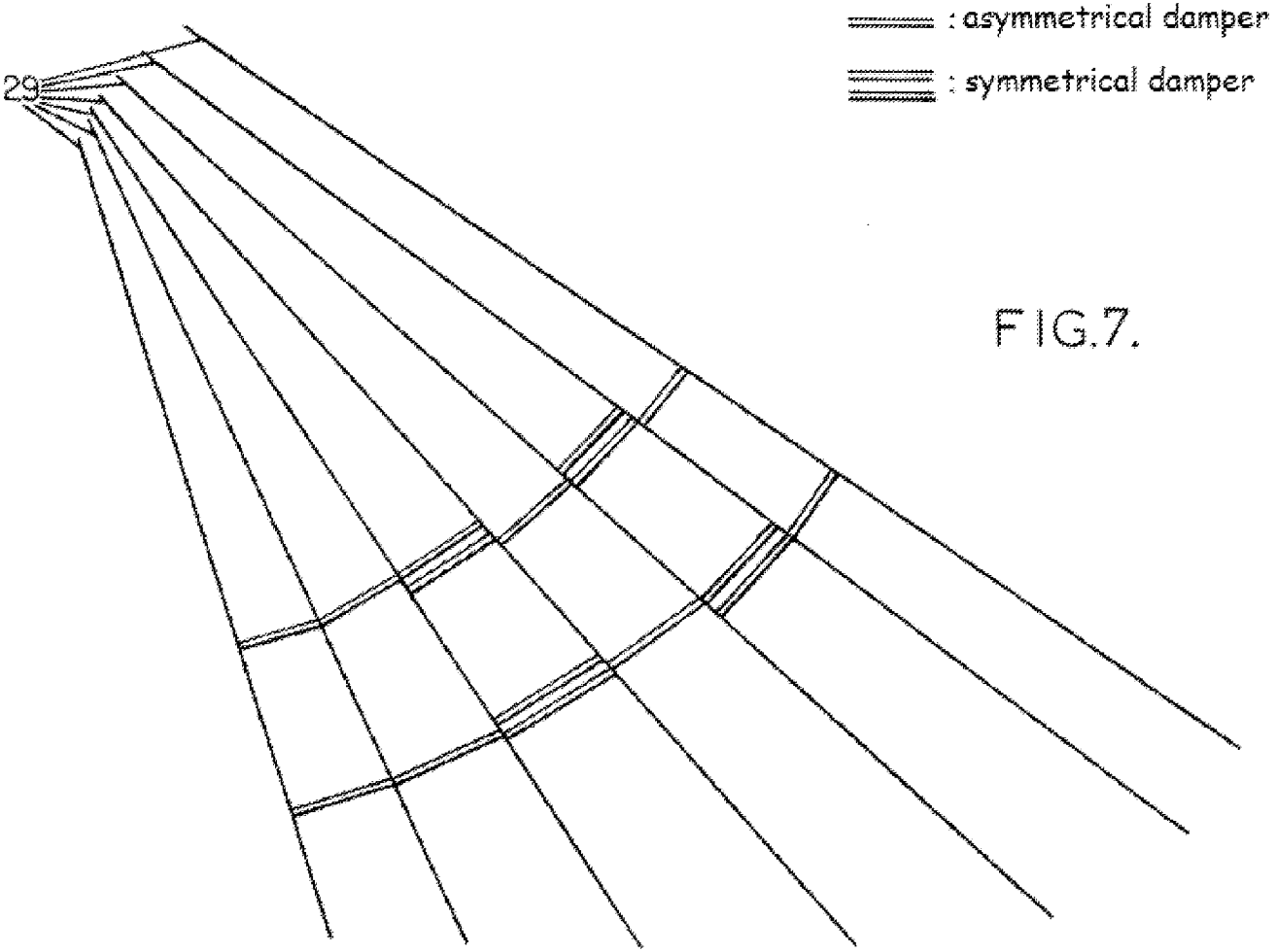
Figure 8:
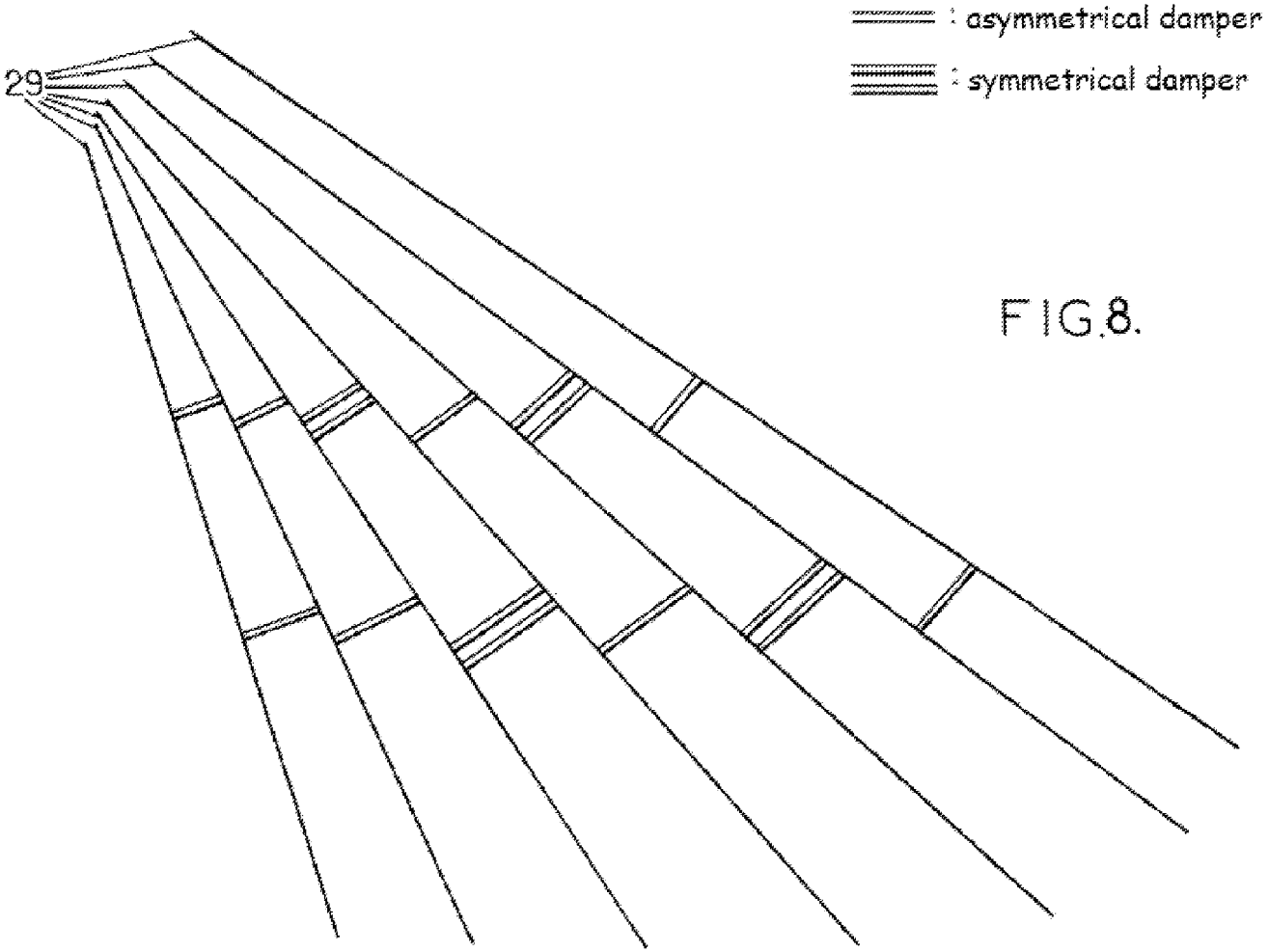
Figure 9:
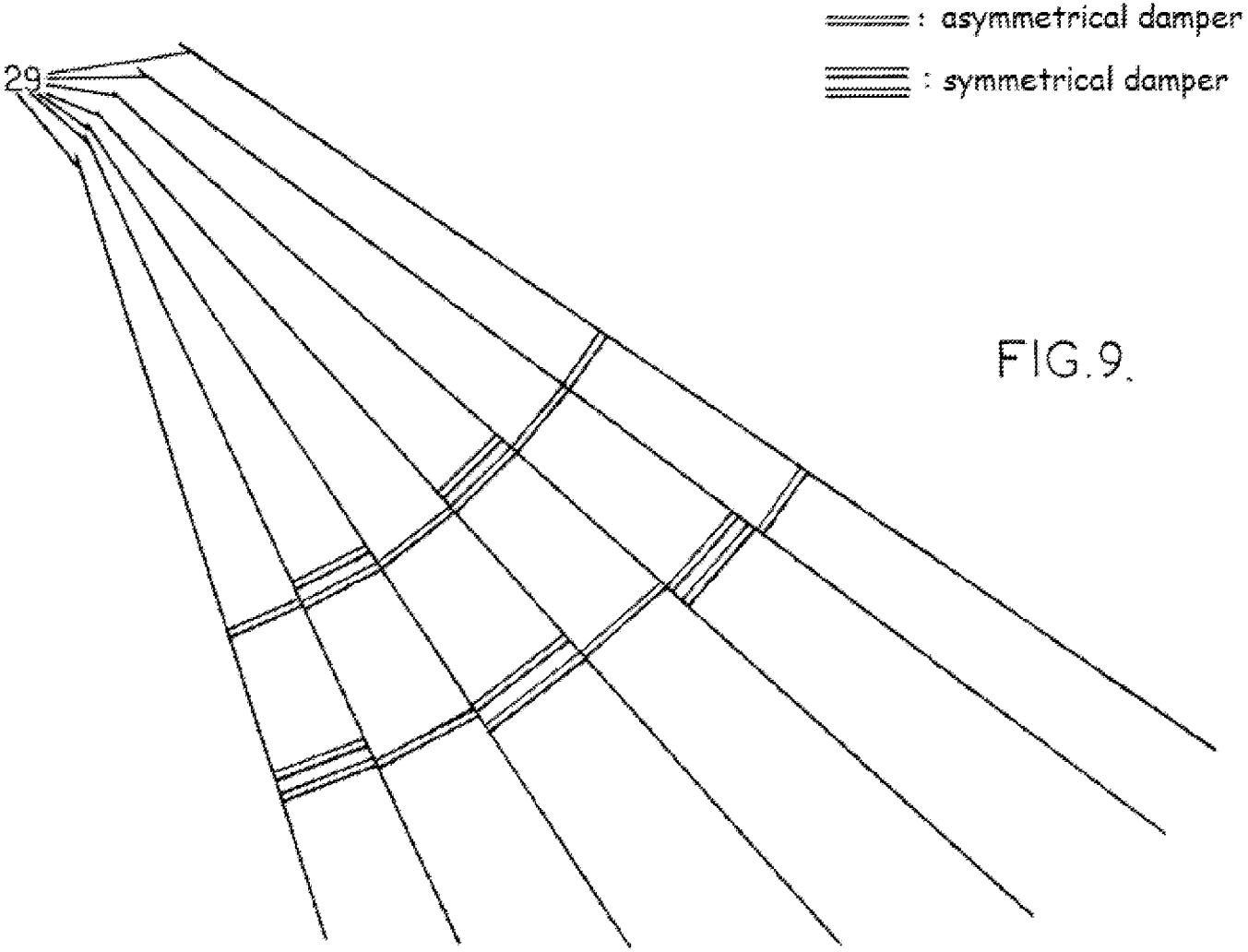
Figure 10:
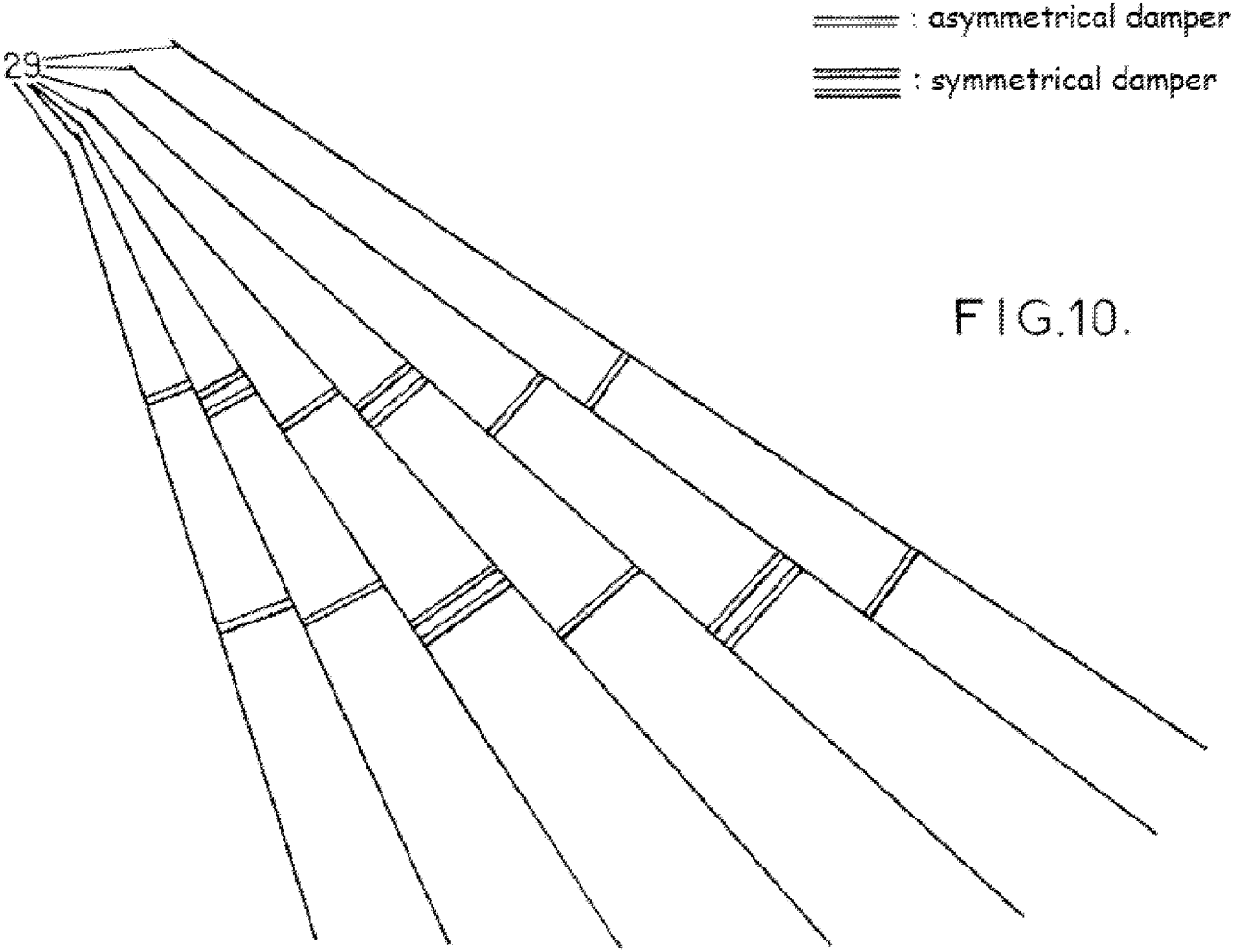
Figure 11:
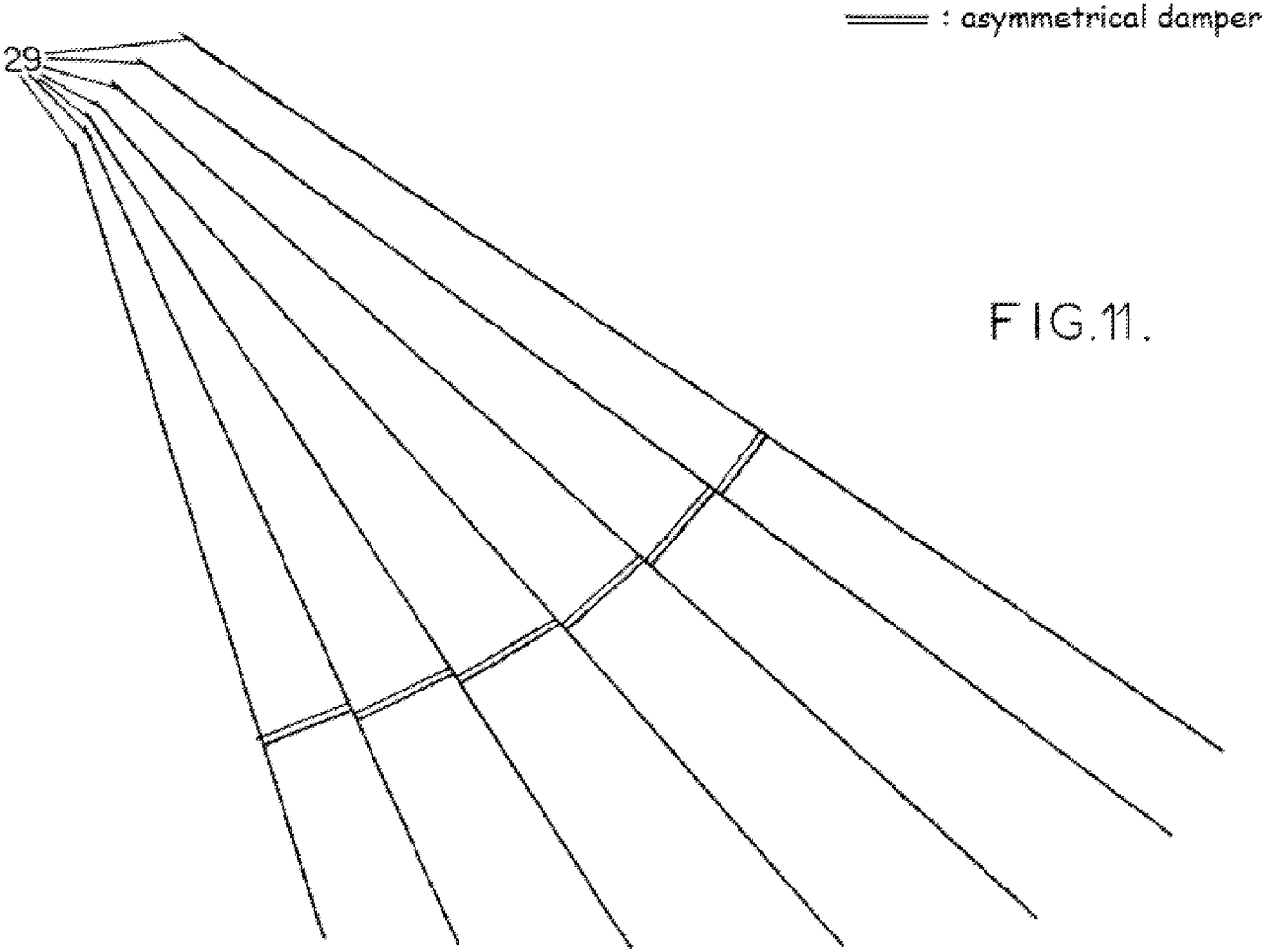
Figure 12:
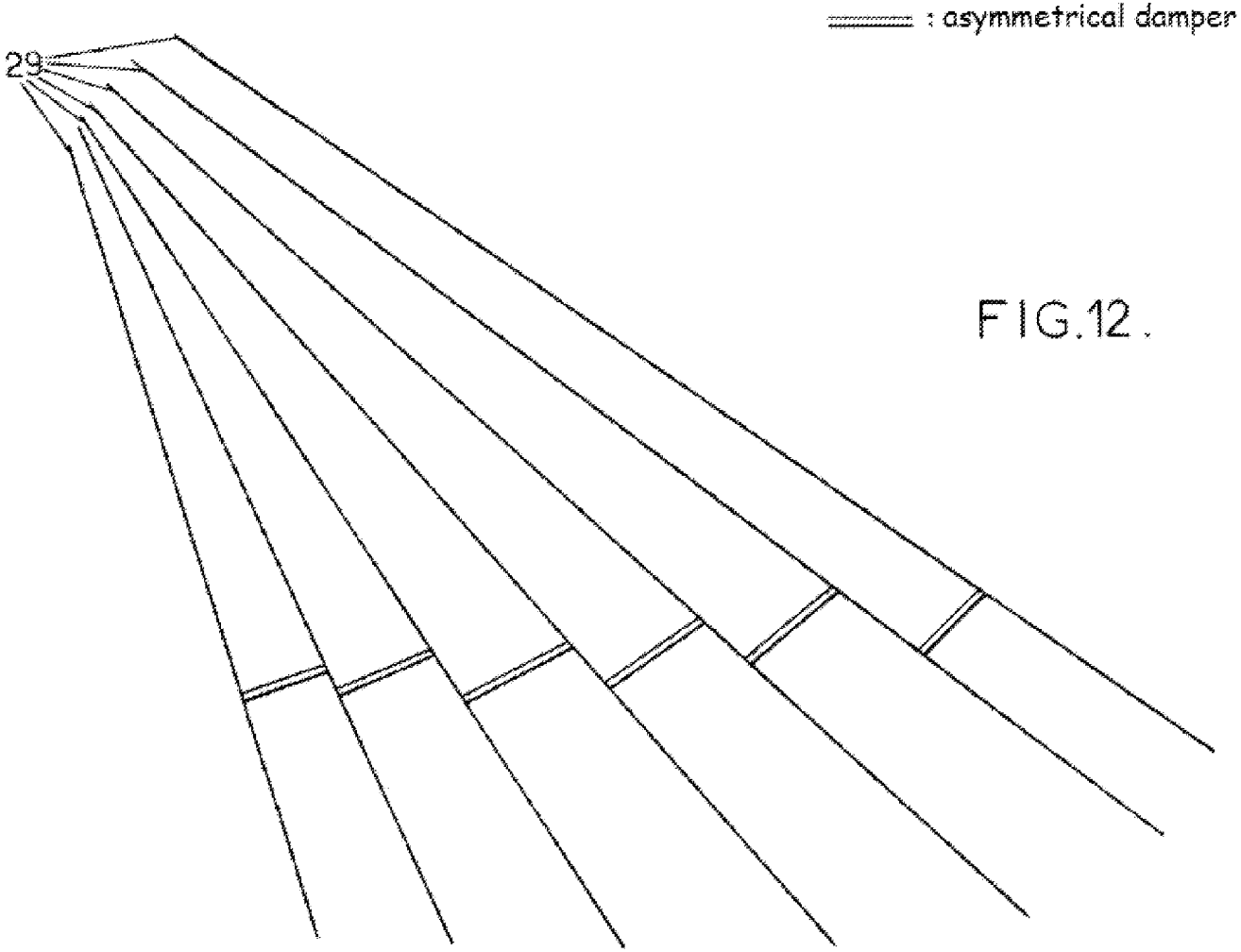
Figure 13:
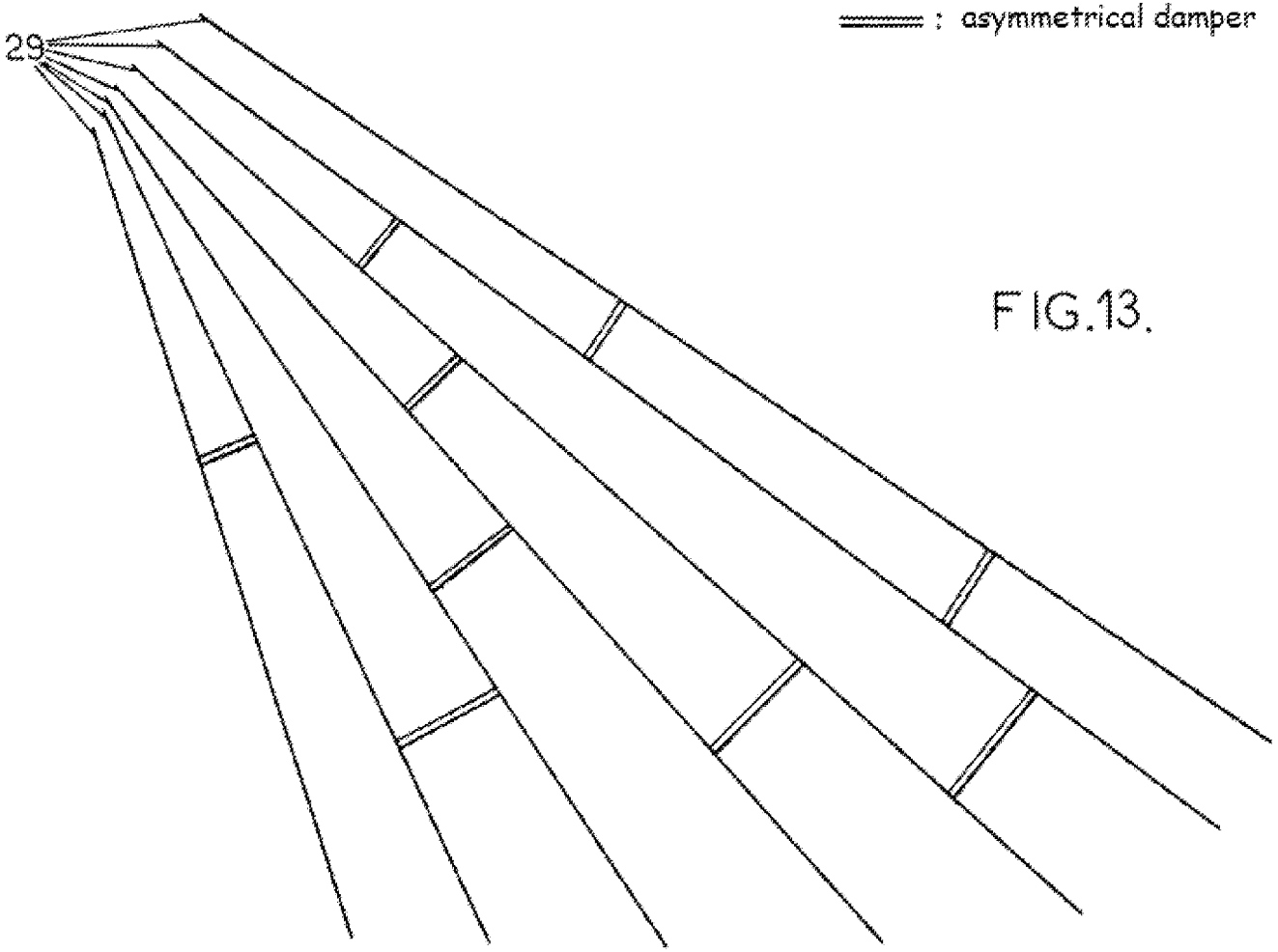

An asymmetrical damper such as just described has mechanical behaviour as shown on the curve 20 in FIG. 4. This curve represents the variations of the force F exerted on the piston 12 (refraction force) as a function of the speed v of displacement of the piston 12 with respect to the body 17. By convention, the left part of the graph, where the speed v is negative, corresponds to the compression (C) of the damper, while the right part of the graph, where the speed v is positive, corresponds to the tension (T) of the damper.

In the example shown in FIG. 4, the behaviour of the asymmetrical damper used can be modelled as follows. Under compression, the damper follows a law of the type: $Fc=\lambda c \times v^{\alpha c}$, where Fc denotes the compressive force developed by the damper, v denotes the speed of displacement of a mobile element of the damper (piston or other), $\lambda c$ denotes a coefficient, and $\alpha c$ denotes an integer or an actual number, for example (but not necessarily) less than 1. Under tension, the damper follows a law of the type: $Ft=\lambda t \times v^{\alpha t}$, where Ft denotes the tensile force developed by the damper, v denotes the speed of displacement of an active element of the damper (piston or other), $\lambda t$ denotes a coefficient, and $\alpha t$ denotes an integer or an actual number, for example (but not necessarily) less than 1.

Moreover, the coefficients $\lambda c$ and $\lambda t$ on the one hand and the exponents $\alpha c$ and $\alpha t$ on the other hand are not identical. They are such that the compressive force Fc has a lower value than the tensile force Ft (for a given value of v). Fc is advantageously weak so as not to create too much instability.

Although an example of an asymmetrical damper has been more particularly described with reference to FIG. 3, other types of asymmetrical dampers could be used within the scope of the present invention, providing that they have greater stiffness in response to tensile stress than in response to compressive stress. Such asymmetrical dampers are not necessarily of the type having a piston and/or substantially rectilinear deformation.

For example an asymmetrical damper without a piston can be considered, working under shear by deformation of a viscoelastic material.

Similarly, while the asymmetrical damper in FIG. 3 is a damper of the passive type, an asymmetrical damper with active control could be used as a variant. Such an asymmetrical damper comprises for example a piston equipped with a speed sensor by means of which a slaved system adapts the viscous coefficient of the piston.

Yet further more or less sophisticated asymmetrical dampers can be envisaged, as a person skilled in the art may see fit.

Advantageously, the difference in stiffness of the asymmetrical damper under tension and under compression must be significant. By way of example, the stiffness under tension is greater than the stiffness under compression in a ratio of at least 1 to 1.2. Applied to the example in FIG. 4, this could result in a coefficient at least 1.2 times greater under tension ($\lambda t$) than under compression ($\lambda c$). As a variant, the ratio between the stiffness under tension and the stiffness under compression could be at least 1 to 2, or at least 1 to 3, or at least 1 to 5, or also at least 1 to 10. A ratio of at least 1 to 100, or even more, can also be envisaged.

In a advantageous embodiment, the stiffness of the asymmetrical damper under compression is zero or almost zero (i.e. as close as possible to zero). In this case, the damper would offer practically no resistance except when in tension. Within the scope of the invention, it is however not necessary for the asymmetrical damper used to be totally flexible under compression. Efficiency under compression is possible and can for example be calculated as a function of the stiffness under rotation of the stay cable(s) concerned and a calculation of three-dimensional (3D) stability.

In the example shown in FIG. 2, the damper 6 comprises a first connection 7 articulated on the first stay cable 4*a* and a second connection 8 articulated on the second stay cable 4*b* directly adjacent to the first stay cable 4*a*. These connections 7 and 8 can be of any type that can be envisaged. One or other of these connections, or even both, can advantageously be a sliding connection, i.e. with little or no friction. In other words, the connection 7 and/or the connection 8 allows rotation about the axis of the corresponding stay cable 4*a* and/or 4*b*.

Moreover, the damper 6 is placed in such a way that its operating axis (the axis of the piston rod in this case) is substantially perpendicular to the stay cables 4*a* and 4*b*, to which it is connected. Its operating axis, in the example considered, is moreover substantially in the plane of the stay cable array 4. The efficiency of the damper 6 is in fact maximum in this configuration, vis-à-vis the vibrations of the stay cables appearing in the plane of the stay cable array 4. Other configurations can however be envisaged.

Moreover, in the example in FIGS. 1 and 2, an asymmetrical damper 6 is arranged between each pair of adjacent stay cables of the stay cable array 4. The asymmetrical dampers 6 connecting successive pairs of adjacent stay cables of the stay cable array run on from each other.

As the damping of the vibrations of the stay cables of the cable-stayed bridge as shown in FIG. 1 uses asymmetrical dampers, this allows for the problem of the movements of stay cables outside the plane of the array, mentioned in the introduction, to be resolved.

As all the connections between the stay cables are almost only under tension or are essentially under tension, the forces of the dampers always tend to return the stay cables to the array to which they belong. As a result, the stay cables can no longer move more than slightly away from the plane of the array.

This gives the following advantages in particular:

- there is no longer instability outside the plane of the array and risk of the occurrence of an angle at the level of the interconnections to the stay cables, which would result in a major loss of damping;
- the use of asymmetrical dampers makes it possible to achieve this result at a lower cost, without having to deploy more sophisticated and therefore costly means;
- the use of asymmetrical dampers makes it possible to retain reduced dimensions for the different components;
- the elimination of instability outside the plane of the array allows for the use of sliding connections (permitting free rotation about the corresponding stay cables) at the level of the interconnections to the stay cables and/or the absence of continuity between the dampers, as mentioned above;
- as the asymmetrical dampers connecting the stay cables operate essentially under tension, their design does not need to take into account compression and buckling, or at least to a lesser extent;
- as the asymmetrical dampers systematically return the stay cables to the plane of the array, they damp the vibrations of the stay cables outside this plane.

A large number of variants of the example that has just been described can be implemented within the scope of the present invention. These variants also make it possible to obtain all or some of the advantages listed above.

FIGS. 5 to 13 show some of these variants. In these figures, the references 29 correspond to stay cables of a civil engineering structure, such as a cable-stayed bridge or other. The single ties appearing between some of the stay cables (such as reference 31 for example) represent asymmetrical dampers, with a stiffness under tension greater than their stiffness under compression, while the double ties shown between certain stay cables (such as reference 30 for example) represent symmetrical dampers.

As can be seen in these figures, the successive pairs of adjacent stay cables of the stay cable array are not necessarily all linked by asymmetrical dampers. A symmetrical damper can follow an asymmetrical damper or a series of several asymmetrical dampers, or also be inserted between two asymmetrical dampers. An alternation of symmetrical and asymmetrical can for example be envisaged. The absence of a damper between two adjacent stay cables of the stay cable array is also possible.

The damper(s) linking the last pair (or the last two pairs) of stay cables of the array is(are) advantageously asymmetrical, in order to avoid the penultimate stay cable leaving the plane of the array.

Several dampers can moreover link two of the same stay cables, in particular when the latter are very long. In this case, it is possible for the dampers linking two of the same stay cables not to be of the same kind, one set being symmetrical and the other set being asymmetrical.

The dampers linking successive pairs of adjacent stay cables can run on from each other, or not. A fixed offset between the dampers can be used to this end, for example so that the distance between the dampers linking two successive pairs of adjacent stay cables is always the same. As variant, less even, or even random, distribution of the dampers can be envisaged.

Advantageously, the positioning of the dampers can be chosen in order to break any combination of frequencies that can result from the vibration behaviour of the stay cables of the array, in order to increase the efficiency of the damping. It is also possible to opt for a distribution of the dampers suitable for avoiding the nodes of the fundamental modes of vibration and therefore avoiding fractions.

In the examples which have been detailed above, several asymmetrical dampers are used, each linked with two stay cables. It will be understood however that the invention could also be implemented in relation to a civil engineering structure comprising a single pair of stay cables. Similarly, each asymmetrical damper used could be linked to more than two stay cables.

At least one of the two stay cables of a pair can moreover optionally be linked to a fixed element of the civil engineering structure to which it belongs, using an asymmetrical damper of the same type as that which links the two stay cables of the pair. In the case of a cable-stayed bridge for example, this could mean that at least one of the two stay cables is connected to the pylon and/or to the bridge deck with an asymmetrical damper.

Other configurations and applications can be envisaged within the scope of the present invention, as a person skilled in the art sees fit.

The invention claimed is:

1. Method of damping the vibrations of at least one pair of stay cables of a stay cable array of a civil engineering structure, in which the stay cable array provides support and stability to the structure, and in which the stay cables of said pair are linked by a damper to damp vibrations between the at least pair of stay cables, the damper having a first stiffness in response to tensile stress and a second stiffness in response to compressive stress due to movement of one stay cable relative to another stay cable of the pair of stay cables of the stay cable array, the first stiffness being greater than the second stiffness, and in which the first stiffness is at least 1.2 times greater than the second stiffness, and in which the second stiffness is almost zero.

2. Method according to claim 1, in which the damper is placed so that an operating axis of said damper is substantially perpendicular to the stay cables of said pair.

3. Method according to claim 1, in which the damper damps the movements in a plane substantially perpendicular to the stay cables of said pair.

4. Method according to claim 1, in which the damper is a damper having a rectilinear stroke.

5. Method according to claim 1, in which the damper operates by a viscous fluid flowing between two chambers separated by a piston, the viscous fluid flow taking place through at least one passage that creates a pressure difference when the viscous fluid passes between the two chambers.

6. Method according to claim 5, in which the pressure difference created by the passage of the fluid is less when the damper is operating under compression in relation to its operation under tension.

7. The method of claim 1, wherein the first stiffness is at least 2 times greater than the second stiffness.

8. The method of claim 1, wherein the first stiffness is at least 3 times greater than the second stiffness.

9. Method according to claim 1, in which at least one of the stay cables of said pair of stay cables is moreover linked to a fixed element of the civil engineering structure by means of a damper having a first stiffness in response to tensile stress and a second stiffness in response to compressive stress, the first stiffness being greater than the second stiffness.

10. Method according to claim 1, in which the connection between the damper and at least one of the stay cables of said pair allows said stay to rotate about the axis.

11. Method according to claim 1, in which the civil engineering structure comprises at least one stay cable array situated substantially in the same plane and including said pair of stay cables, and in which the damper is positioned so that an operating axis of said damper is substantially within said plane of the stay cable array.

12. Method according to claim 11, in which the stay cable array is constituted of at least three stay cables, and in which dampers link at least certain pairs of adjacent stay cables of the stay cable array, at least one of said dampers having a first stiffness in response to tensile stress and a second stiffness in response to compressive stress, the first stiffness being greater than the second stiffness.

13. Method according to claim 12, in which the dampers linking the certain pairs of adjacent stay cables of the stay cable array are arranged in parallel relative to each other such that the dampers are not in continuation of each other.

14. Method according to claim 1, in which the civil engineering structure comprises a cable-stayed bridge.

15. The method of claim 1, wherein the first stiffness is at least 5 times greater than the second stiffness.

16. The method of claim 1, wherein the first stiffness is at least 10 times greater than the second stiffness.

17. System comprising a civil engineering structure having a stay cable array and dampers arranged for damping vibrations of at least three stay cables of the stay cable array of the civil engineering structure, wherein said stay cable array provides support and stability to the structure, wherein the at least three stay cables are substantially in the same plane, said dampers being connected to the stay cables of the at least three stay cables, each damper having a first stiffness in response to tensile stress and a second stiffness in response to compressive stress, the first stiffness being greater than the second stiffness, and in which the dampers are positioned between the at least three cable stays so that an operating axis of each damper is substantially within the same plane of the at least three cable stays, and in which the second stiffness is almost zero.

18. System according to claim 17, in which each damper is placed so that an operating axis of said damper is substantially perpendicular to the stay cables of said pair.

19. System according to claim 17, in which each damper is arranged for damping the movements in a plane substantially perpendicular to the stay cables of said pair.

20. System according to claim 17, in which each damper has a rectilinear stroke.

21. System according to claim 17, in which each damper is arranged for operating by a viscous fluid flowing between two chambers separated by a piston, the viscous fluid flow taking place through at least one passage that creates a pressure difference when the viscous fluid passes between the two chambers.

22. System according to claim 21, in which the pressure difference created by the passage of the fluid is less when each damper is operating under compression in relation to its operation under tension.

23. System according to claim 17, in which the first stiffness is greater than the second stiffness in a ratio of at least 1 to 1.2.

24. System according to claim 17, in which at least one of the stay cables of said at least three stay cables is moreover linked to a fixed element of the civil engineering structure by means of at least one damper having a first stiffness in response to tensile stress and a second stiffness in response to compressive stress, the first stiffness being greater than the second stiffness.

25. System according to claim 17, in which the connection between at least one damper and at least one of the at least three stay cables allows said stay to rotate about the axis.

26. System according to claim 17, in which the dampers linking adjacent stay cables of the stay cable array are arranged in parallel relative to each other such that the dampers are not in continuation of each other.

27. System according to claim 17, in which the civil engineering structure comprises a cable-stayed bridge.

28. The system of claim 17, wherein the first stiffness is at least 2 times greater than the second stiffness.

29. The system of claim 17, wherein the first stiffness is at least 3 times greater than the second stiffness.

30. The system of claim 17, wherein the first stiffness is at least 5 times greater than the second stiffness.

31. The system of claim 17, wherein the first stiffness is at least 10 times greater than the second stiffness.

* * * * *